United States Patent [19]

Alber et al.

[11] 4,236,134

[45] Nov. 25, 1980

[54] MULTIPHASE TRANSFORMER FOR POWER TRANSMISSION IN A SUPPLY SYSTEM

[75] Inventors: Friedrich Alber, Köngen; Gerhard Altmann, Kirchheim; Wolfgang Bendel, Leonberg; Rudolf Dedelmahr, Aich; Hermann Eyrich, Kirchheim; Rudolf Link, Bissingen; Klaus Seeliger, Weilheim, all of Fed. Rep. of Germany

[73] Assignee: Transformatoren Union AG, Stuttgart, Fed. Rep. of Germany

[21] Appl. No.: 46,859

[22] Filed: Jun. 8, 1979

[30] Foreign Application Priority Data

Jun. 15, 1978 [DE] Fed. Rep. of Germany ..... 2826299

[51] Int. Cl.[3] ..... H01F 27/02

[52] U.S. Cl. ..... 336/96; 174/37; 336/107

[58] Field of Search ..... 336/96, 205, 5, 10, 336/12, 90, 100, 223, 105, 107, 192, 60, 92; 174/37

[56] References Cited

U.S. PATENT DOCUMENTS

| | | | |
|---|---|---|---|
| 3,569,884 | 3/1971 | Wright et al. | 336/96 |
| 3,750,071 | 7/1973 | Eley | 336/96 X |

FOREIGN PATENT DOCUMENTS

| | | | |
|---|---|---|---|
| 2054567 | 5/1972 | Fed. Rep. of Germany | 336/60 |
| 2243383 | 4/1976 | Fed. Rep. of Germany | 336/90 |
| 2032507 | 3/1977 | Fed. Rep. of Germany | 336/60 |

*Primary Examiner*—Thomas J. Kozma
*Attorney, Agent, or Firm*—Herbert L. Lerner

[57] ABSTRACT

Multiphase transformer for power distribution in a supply network includes a single block of cast resin having high voltage and low voltage conductor windings embedded therein, and an iron core with a plurality of legs and an upper and lower yoke formed of closely-stacked transformer laminations centrally embedded in the block, the block having axially-extending ribs integral therewith defining troughs between the ribs and defining spaces between the ribs and the core, legs and yokes, watertight caps disposed between the ribs closing off the troughs and holding the core, legs and yokes, and mechanically compacted dry quartz sand filled in the space.

10 Claims, 4 Drawing Figures

MULTIPHASE TRANSFORMER FOR POWER TRANSMISSION IN A SUPPLY SYSTEM

The invention relates to transformers for use in crowded innercity areas where the floor space required for construction of new, or expansion of existing, transformer stations is frequently no longer available today, or certainly will not be in the future. One way to accommodate the necessary distribution transformers is to use underground installations. In such installation, the transformers disposed in the ground take over the supply to the connected consumers alone or as an extension to existing conventional equipment.

In German Published Non-Prosecuted Application, DE-OS No. 22 43 383, construction for employing a transformer underground is described. An active part of conventional construction which includes windings and an iron core, is built into an underground tank filled with coolant. As is customary, the coolant is cooled in the transformer in a separate heat exchanger. Since the heat exchanger depends on convection with air or another medium absorbing dissipation heat and must, therefore, be installed above ground, at least part of the initially-gained installation space is lost again.

On the other hand, it is also known from German Patent DE-PS No. 20 32 507 and German Published Non-Prosecuted Application DE-OS No. 20 54 567, for the purpose of providing compact, securely insulated windings of transformers, to embed them in cast resin. However, in these construction arrangements, cooling ducts are also either cast-in or are formed by corresponding spacings of assembled subassemblies, so that the dissipation heat produced can be removed. In addition, for connecting the windings of multiphase transformers, special connections in the form of terminal strips, for instance, are required in these transformers. In general, these transformers with windings embedded in cast resin are so-called dry transformers, that is, the ambient air is also used at least in part for insulating the windings.

It is accordingly an object of the invention to provide a multiphase transformer for power transmission in a supply system which overcomes the hereinafore-mentioned disadvantages of the heretofore known devices of this general type, with windings embedded in cast resin and which, together with a required medium- and low-voltage cable network, can be buried or dug into the ground at suitable locations.

With the foregoing, and other objects in view, there is provided, in accordance with the invention, a multiphase transformer for power distribution in a supply network comprising a single block of cast resin having high voltage and low voltage conductor windings embedded therein, and an iron core with a plurality of legs and an upper and lower yoke formed of closely-stacked transformer laminations centrally embedded in the block, the block having axially-extending ribs integral therewith defining troughs between the ribs and defining spaces between the ribs and the core, legs and yokes, watertight caps disposed between the ribs closing off the troughs and holding the core, legs and yokes, and mechanically compacted dry quartz sand filled in the spaces.

In accordance with another feature of the invention, one of the conductor windings is formed of a conductor ribbon.

In accordance with a further feature of the invention, one of the conductor windings is formed of conductor foil.

In accordance with an added feature of the invention, the caps are form-fittingly anchored in the ribs, and there is provided a bulk-elastic layer disposed between the caps and the yokes.

In accordance with an additional feature of the invention, there are provided cable sections connectible to the high-voltage winding, cable sections having ends cast into the block which are substantially 5 meters long.

In accordance with yet another feature of the invention, the block has a rectangular cross section and there are provided pin insulators connectible to the low-voltage winding with terminal screws, the pin insulators being cast onto one narrow side of the block.

In accordance with yet a further feature of the invention, the transformer is buried under ground, if used in connection with cables, and there is provided a layer of sand at least 2 meters thick covering all sides of the transformer.

In accordance with still another feature of the invention, the core legs and block have rectangular cross section, the longer sides of which are parallel, the ratio of the sides of the legs being at least 1.9:1, and the ratio of the block being at least 3:1.

In accordance with a concomitant feature of the invention, there is provided a shrink tube hermetically sealing the terminal screws from the environment i.e. from the soil.

The transformer according to the invention can be used to great advantage because, through its planned employment, the presently used, very extensive, relatively cost-intensive, low-voltage network of cables with large cross sections can be dispensed with and replaced with a system which has been reduced to short spurs to the individual customers. The buried or dug-in transformers themselves, which are completely encapsulated in cast resin, are fed directly from the medium-voltage network of cables with a small conductor cross section associated therewith.

Through the length-to-width ratio which is very large for transformers, there is additionally obtained a sufficiently large surface to transfer the dissipation heat produced in the transformer to the soil. If the environment has no ground water, the poor thermal conductivity of dry soil must be taken into consideration.

Other features which are considered as characteristic for the invention are set forth in the appended claims.

Although the invention is illustrated and described herein as embodied in multiphase transformer for power transmission in a supply system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
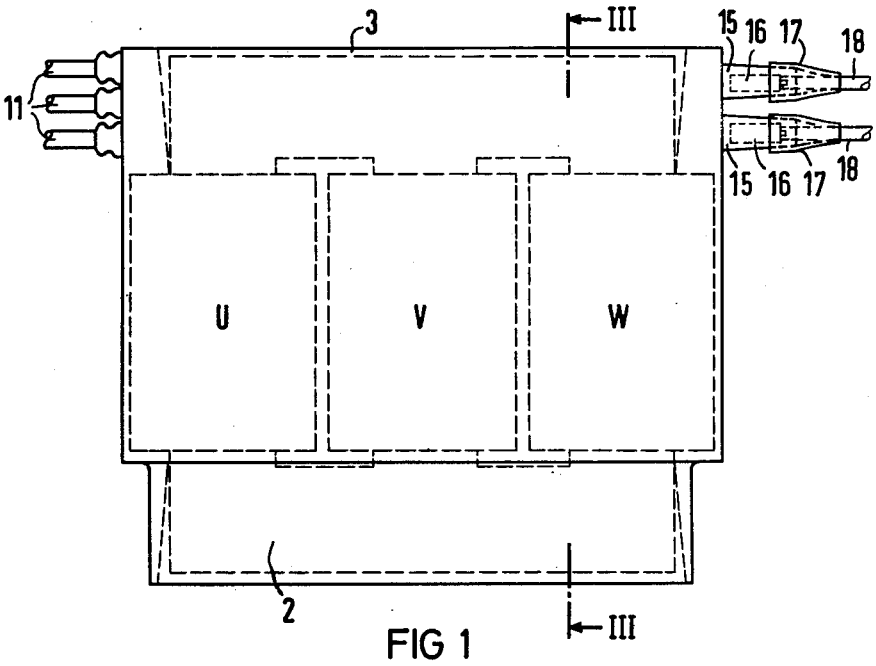
FIG. 1 is a front elevational view of the multiphase transformer according to the invention.
Figure 2:
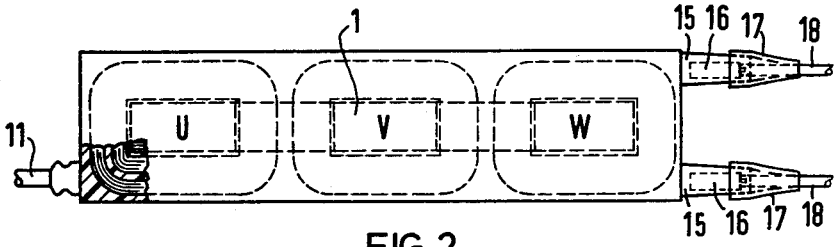
FIG. 2 is a top plan view of FIG. 1.
Figure 3:
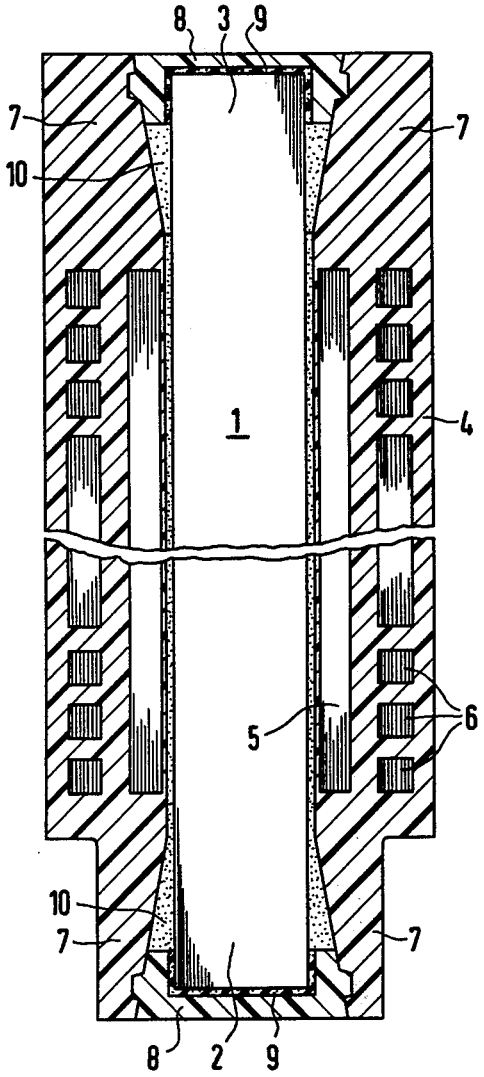
FIG. 3 is a longitudinal sectional view of FIG. 1, taken along the line III—III in the direction of the arrows.
Figure 4:
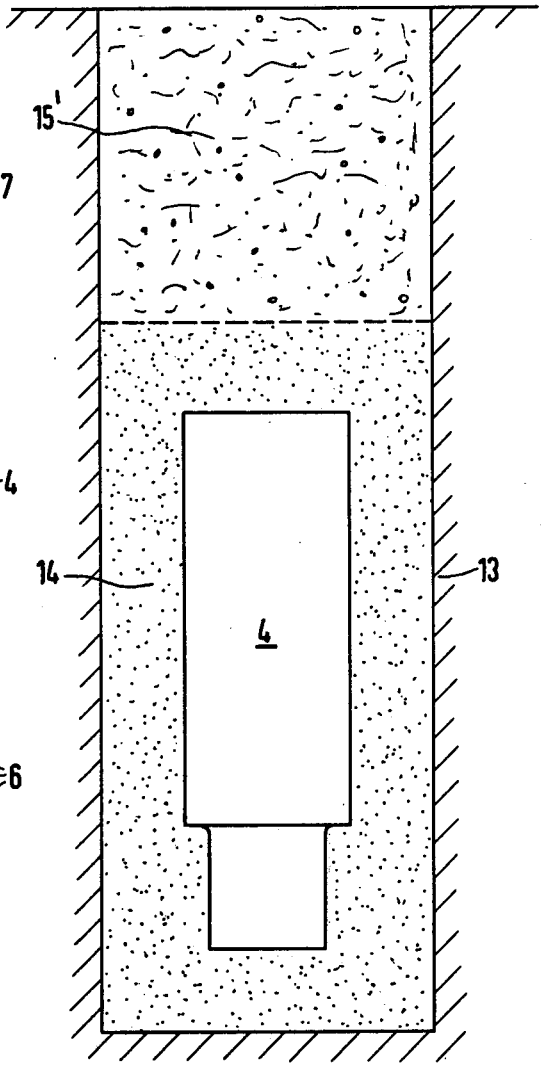
FIG. 4 is a side-elevational view of the multiphase transformer of the invention in the installed position.

Referring now, simultaneously, to FIGS. 1 to 4 of the drawings, there are seen low-voltage windings 5 and high-voltage windings 6 disposed around core legs 1 in a block of cast resin 4 containing three phases U, V, W. The core legs 1 are connected to each other by a lower yoke 2 and an upper yoke 3. The lower yoke 2 and the upper yoke 3 are flanked by ribs 7 which are formed on the block of cast resin 4 at the end faces of the high-voltage windings 6.

The lower yoke 2 and the upper yoke 3, as well as the core legs 1 held by them, are secured by caps 8 in such a manner that they do not directly touch the block of cast resin 4 anywhere. The caps 8 are anchored in a form-fitting manner in the ribs 7 of the cast-resin block 4 and close off its interior in such a way that it is watertight with respect to the outside. To compensate for different temperature-dependent length changes, bulk-elastic intermediate layers 9 are disposed between the caps 8 and the lower yoke 2 and between the caps 8 and the upper yoke 3. Before the space 10 between the cast-resin block 4 and the iron of the core legs 1 and the yokes 2 and 3 is ultimately sealed, the space 10 is filled with dry quartz sand, which is mechanically compacted in the process. The caps 8 are preferably sequentially cast directly into the existing transformer construction and are formed, likewise, of synthetic resin.

Leads required for interconnecting and connecting the high-voltage windings 6, as well as the low-voltage windings 5 are installed in the ribs 7 in a manner which is not shown in detail. To connect the high-voltage windings 6 to a medium-voltage supply network, cable sections 11 are cast into the rectangularly-shaped cast-resin block 4, from which they emerge at the height of the ribs 7 from one narrow or short side thereof. On the opposite short or narrow side of the cast-resin block 4, pin insulators 15 are similarly formed on the cast-resin block 4 at the height of the upper ribs 7. In the pin insulators 15, the connecting lines for the low voltage are brought to terminal screws 16, where they are connected to cables 18 inside shrink tubes 17 which hermetically seal the connection.

The multiphase transformer according to the invention, together with associated cables is buried or dug into the soil 13 for deployment. To ensure at least a minimum amount of heat removal, a sand layer 14, at least 0.2 meters thick is provided around the cast-resin block 4 on all sides thereof. The space in the hole which may be left above this sand is filled up with fill or earth 15'.

In consideration of the normally relatively poor heat removal, especially in dry soil 13, the transformer is constructed as a rectangular transformer with a side ratio in the core leg cross-sections of at least 1.9:1 and a length-to-width ratio of the entire transformer of at least 3:1. The slab-like shape of the multiphase transformer provides a large surface-to-volume ratio and thus, relatively large heat removal.

We claim:

1. Multiphase transformer for power distribution in a supply network, comprising a single block of cast resin having high voltage and low voltage conductor windings embedded therein, and an iron core with a plurality of legs and an upper and lower yoke formed of closely-stacked transformer laminations centrally embedded in said block, said block having axially-extending ribs integral therewith defining troughs between said ribs and defining spaces between said ribs and said core, legs and yokes, watertight caps disposed between said ribs closing off the troughs and holding said core, legs and yokes, and mechanically compacted dry quartz sand filled in the spaces.

2. Multiphase transformer according to claim 1, wherein one of said conductor windings is formed of a conductor ribbon.

3. Multiphase transformer according to claim 1 wherein one of said conductor windings is formed of conductor foil.

4. Multiphase transformer according to claim 1, wherein said caps are form-fittingly anchored in said ribs, and including a bulk-elastic layer disposed between said caps and said yokes.

5. Multiphase transformer according to claim 4, including cable sections connectible to said high-voltage winding, said cable sections having ends cast into said block.

6. Multiphase transformer according to claim 5, wherein said cable sections are substantially 5 meters long.

7. Multiphase transformer according to claim 1, wherein said block has a rectangular cross section, and including pin insulators connectible to said low-voltage winding with terminal screws, said pin insulators being cast onto one narrow side of said block.

8. Multiphase transformer according to claim 1, wherein said transformer is buried under ground, and including a layer of sand at least 0.2 meters thick covering all sides of said transformer.

9. Multiphase transformer according to claim 8, wherein said core legs and block have rectangular cross sections, the longer sides of which are parallel, the ratio of the sides of said legs being at least 1.9:1, and the ratio of the sides of said block being at least 3:1.

10. Multiphase transformer according to claim 7, including a shrink tube hermetically sealing said terminal screw from the environment.

* * * * *